US009598877B2

(12) United States Patent
Longest et al.

(10) Patent No.: US 9,598,877 B2
(45) Date of Patent: Mar. 21, 2017

(54) FLUSH PULL DOOR HANDLE

(71) Applicant: NATIONAL SECURITY AND DOOR CORP., North Chesterfield, VA (US)

(72) Inventors: Mark Allen Longest, Blackstone, VA (US); Scott Childress, Powhatan, VA (US)

(73) Assignee: National Security and Door Corp., N. Chesterfield, VA (US)

( * ) Notice: Subject to any disclaimer, the term of this patent is extended or adjusted under 35 U.S.C. 154(b) by 0 days.

(21) Appl. No.: 14/816,378

(22) Filed: Aug. 3, 2015

(65) Prior Publication Data

US 2017/0037654 A1 Feb. 9, 2017

(51) Int. Cl.

| | |
|---|---|
| ***E05B 3/00*** | (2006.01) |
| ***E05B 5/00*** | (2006.01) |
| ***A47B 95/02*** | (2006.01) |

(52) U.S. Cl.

CPC ..... *E05B 5/006* (2013.01); *A47B 95/02* (2013.01)

(58) Field of Classification Search

CPC ..... A47J 45/06; A47B 95/02; A47B 88/00; A47B 2095/024; A47B 2095/026; A47B 2095/027; F24C 15/024; E05B 5/00; E05B 5/006; E05B 1/00; E05B 1/0015; E05B 1/04; E05B 1/06; E05B 85/10; E05B 85/103

USPC ..... 292/336.3, DIG. 53, DIG. 54, DIG. 63, 292/DIG. 68, DIG. 38; 16/110.1, 415, 16/416, 425, 412, 413, DIG. 19, DIG. 24, 16/DIG. 25; 312/204, 244, 348.6; 296/1.02; 70/208, 215, 224, 207

See application file for complete search history.

(56) References Cited

U.S. PATENT DOCUMENTS

| | | | | | |
|---|---|---|---|---|---|
| 3,775,808 | A | * | 12/1973 | Little | A47B 97/02 16/412 |
| 4,118,895 | A | * | 10/1978 | Governale | E05B 63/08 49/503 |
| 4,218,848 | A | * | 8/1980 | Nelson | E05B 63/10 49/503 |
| 4,456,290 | A | * | 6/1984 | Gross | E05B 65/0025 292/337 |
| 4,744,126 | A | * | 5/1988 | Bisbing | A45C 13/26 16/443 |
| 4,875,726 | A | * | 10/1989 | Thau | E05B 79/06 292/337 |

(Continued)

*Primary Examiner* — Alyson M Merlino

(74) *Attorney, Agent, or Firm* — Timothy J. Bechen; Bechen PLLC

(57) ABSTRACT

The present invention provides a flush pull handle affixable to a door. The handle includes a mounting assembly including a top portion, bottom portion, first side portion and a second side portion, the mounting assembly affixable to the door via at least one fastener. The mounting assembly includes at least one mounting flange. The handle further includes a pull assembly including an assembly interior portion having a first interior side and a second interior side, the first interior side having at least one flange mount opening. The pull assembly includes an assembly face having a handle flush with the pull assembly extruding across at least a portion of the assembly interior portion for allowing a pulling action on the door handle. Such that, the pull assembly mounts in the mounting assembly based at least on the mounting flange of the mounting assembly extruding through the flange mount opening.

20 Claims, 4 Drawing Sheets

(56) References Cited

U.S. PATENT DOCUMENTS

| | | | | | |
|---|---|---|---|---|---|
| 5,074,009 | A | * | 12/1991 | Simonton | A47B 95/02 16/416 |
| 5,355,554 | A | | 10/1994 | Magoon | |
| 5,553,354 | A | * | 9/1996 | Trulaske, Sr. | A47B 95/02 16/412 |
| D386,962 | S | * | 12/1997 | Greener | D8/313 |
| 6,132,540 | A | * | 10/2000 | Barber | E06B 3/7001 156/242 |
| 6,282,753 | B1 | | 9/2001 | Hochmuth | |
| 6,318,026 | B1 | * | 11/2001 | Ayres | E05B 9/02 49/503 |

* cited by examiner

FLUSH PULL DOOR HANDLE

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

The present application relates to a flush pull door handle and more specifically to a flush pull door handle and assembly affixable and readily removable from a door.

Door handles primarily consist of knobs, arms or similar shapes. These types of handles have varying benefits, including reducing difficulties for persons with disabilities to use the door. Most public buildings, including schools, government buildings, corporate offices, etc. have pull handles that extend out from the door.

It is also very common for large entrance areas to include double-doors with mirrored door handles extending out from the door. While on the interior portion of the door, there are usually push-bars or emergency exit bars based on fire code requirements. The technology relating to the existing outwardly extending door handles is well known and well established in the marketplace.

Problems can arise from outwardly extending door handles, including significant safety concerns. For example, it is possible for a malfeasant actor to apply chains to the door via the handles, preventing the doors from being opened from the inside. The door handles, extending out from the door, provide the perfect hooking mechanisms to grasp chains or other items causing the doors to remain unopenable. Such events have occurred in at least one mass casualty on a university campus, students having lost their lives in part from being trapped from chains around door handles preventing escape.

A flush pull handle mounted on a door provides a simple solution to prevent doors from being held secured together using chains or other means. The problem is that flush pull handle technology is extremely limited. Current flush pull handles are physically molded into the doors themselves. For example, U.S. Pat. No. 6,282,753 describes a flush mount door handle that is recessed within a doorframe, but this door handle is physically mounted into the door such that the handle cannot be removed or changed without dismantling the actual door. This prior art flush pull handle focuses on the novel design of having an angled back portion to allow cleaning.

Another example of limiting flush pull handle prior art is U.S. Pat. No. 5,355,554 showing a pull handle that can be inserted into an existing door. While this allows for minor modifications to the door, this prior art door handle further evidences the limitations of needing to modify or take apart the door to install and remove the door handle. In this system, the door handle is secured to the door itself while the door is being manufactured. This system then requires the manufacturing of the door and the pull handle to be done concurrently, as well as limiting the door to always require that pull handle. If the handle needs repair or replacement, the door itself must be taken apart or the whole door is then replaced.

Existing safety concerns note the value of a flush pull door handle to prevent the doors from being improperly secured together. But, the existing prior art require manufacturing of the door and the handle together, thus requiring a special manufacture of the door. Similarly, the existing technology, by combining the door and the handle into a single manufactured unit, inhibits removal and/or replacement of the handle.

As such, there exists a need for a flush pull door handle that can be affixed into a door assembly, as well as readily removable.

BRIEF DESCRIPTION

The present invention provides a flush pull handle affixable to a door. The handle includes a mounting assembly including a top portion, bottom portion, first side portion and a second side portion, the mounting assembly affixable to the door via at least one fastener. The mounting assembly includes at least one mounting flange. The handle further includes a pull assembly including an assembly interior portion having a first interior side and a second interior side, the first interior side having at least one flange mount opening. The pull assembly includes an assembly face having a handle flush with the pull assembly extruding across at least a portion of the assembly interior portion for allowing a pulling action on the door handle. Such that, the pull assembly mounts in the mounting assembly based at least on the mounting flange of the mounting assembly extruding through the flange mount opening.

BRIEF DESCRIPTION OF THE DRAWINGS

The invention described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

Figure 1:
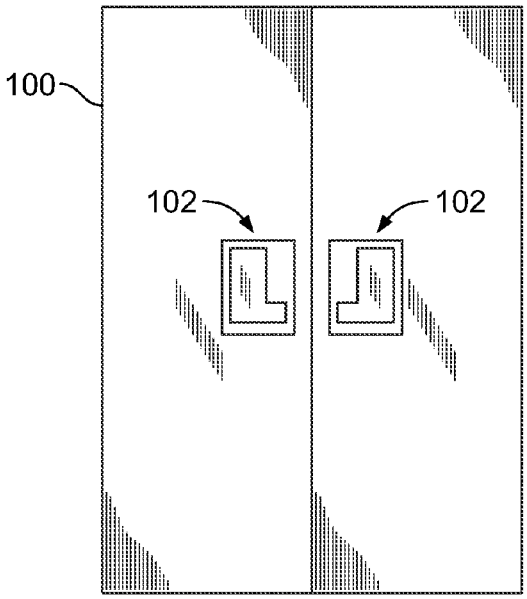
FIG. 1 is a front view of a door with flush pull handles installed thereon.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

FIG. 1 illustrates a front view of a door 100 having the flush pull handles 102 installed thereon. As described in greater detail below, the flush pull handles 102 are flush with the door 100, with an interior portion allowing for grasping the pull portion of handle and opening the door. The pull handles 102 are custom interlocking, fully serviceable chain resistance security pulls. The handles 102 are serviceable by being readily removable without having to disassemble the door 100. Moreover, the pulls mount within the door, not through the door, such that if the pull handle if removed, there is no access to the other side of the door or any of the door locking mechanisms. Similarly, the pull handles 102 can be installed on a standard door having an internal bracing or bracket component, but does not require manufacturing of the handle into the door, thereby simplifying the door 100 manufacturing and assembly processes.

The pull handle 102 of FIG. 1 includes a mounting assembly and a pull assembly, where the mounting assembly is mounted to the door 100 and the pull assembly is therein mounted to the mounting assembly.

Figure 2:
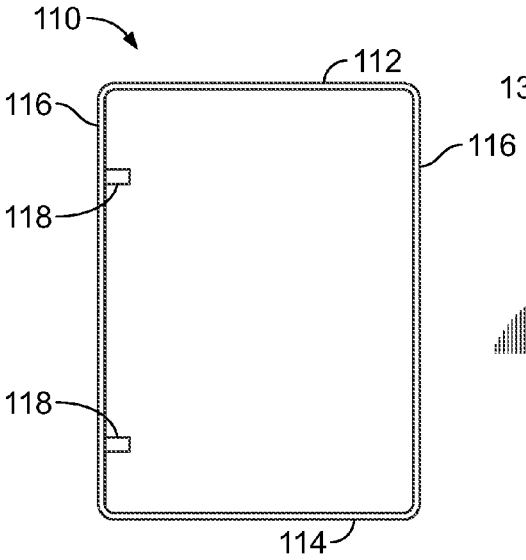
FIG. 2 is a front view of one embodiment of a mounting assembly.

FIG. 2 illustrates a front view of one embodiment of a mounting assembly 110. The mounting assembly is rectangular in shape having a top portion 112, bottom portion 114 and two side portions 116. In this embodiment, two mounting flanges 118 are disposed on one of the side portions 116. The mounting assembly 110 further includes fastener openings, not visible in the front view of FIG. 2, but described in greater detail below. As illustrated, the assembly 110 includes slightly curved edges but may contain squared edges.

Figure 3:
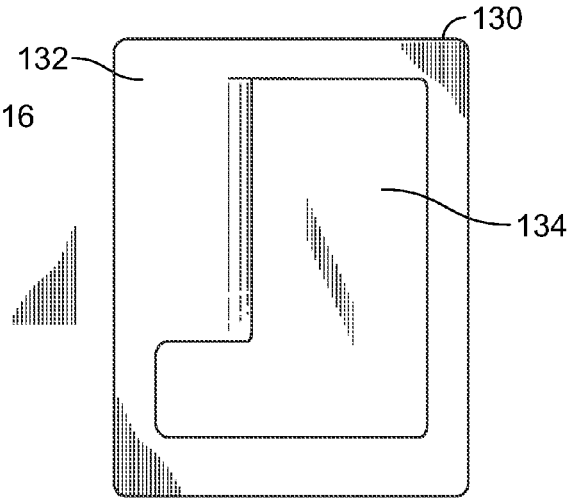
FIG. 3 is a front view of one embodiment of a pull assembly.

FIG. 3 illustrates a front view of one embodiment of a pull assembly 130 having an assembly face 132 and an assembly interior 134. As also described in further detail below, the assembly face 132 includes a handle portion extending across a portion of the assembly interior 134, allowing for pull access to the door such that a person can grasp the extending portion of the assembly face 132 to open the door.

In one embodiment, the pull handle portion of the assembly face 132 extending over the interior portion includes a curved edge, such as in one embodiment a 18 degree offset allowing for improved grip of the handle. For example, the pull handle portion allowing for user to grab the pull handle can be curved or designed to not required tight grasping, pinching or twisting for opening the door, such as may be in full compliance with any local, state or Federal guidelines.

It is recognized that the illustration portion of the face 132 of FIG. 2 represents one of any number of suitable embodiments for the shape of the face, such as for example inverting the face 132 relative to a left door or a right door. By way of example, FIG. 1 illustrates the inverted door handles for both a left door pull and a right door pull.

Figure 4:
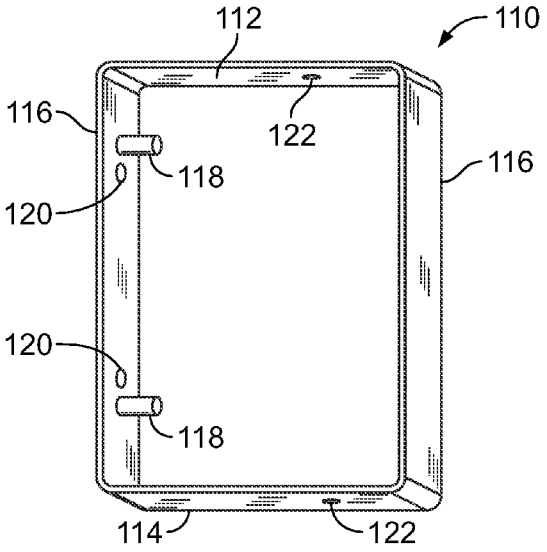
FIG. 4 is a perspective view of one embodiment of a mounting assembly.

For further clarification of the mounting assembly 110, FIG. 4 illustrates a perspective view of one embodiment of the mounting assembly 110. In this embodiment, the top portion 112 and the bottom portion 114 include mating elements 122 for receipt of a fastener securing the pull assembly to the mounting assembly 130. In one embodiment, the mating elements 122 are threaded holes to receive fasteners as described in further detail below. The side portion 116 further includes a plurality of fastener openings 120 in this embodiment between the mounting flanges 118.

As described in further detail below, a fastener (not shown in FIG. 4) is inserted through the fastener openings 120 on the side portion 116 to secure the mounting assembly 110 to a bracing assembly inside a door. In the embodiment of FIG. 4, the fastener openings 120 are on the one side portion, but it is recognized they may additionally be installed on the opposing side portion 116 for further secure mounting. Whereas, in this embodiment, the pulling action to open a door generates a force relative via the mounting flanges 118, therefore the bracing is most efficiently secured near the flanges 118, but such securing location is not expressly limited to the side having mounting flange (s) 118.

Figure 5:
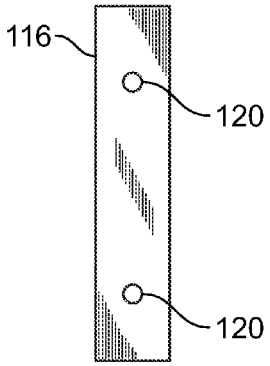
FIG. 5 is a side view of one embodiment of a mounting assembly.
Figure 6:
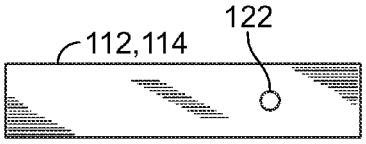
FIG. 6 is a top view and/or a bottom view of one embodiment of a mounting assembly.

For further illustration, FIG. 5 illustrates an exterior side view of the side portion 116. The exterior view illustrates the fastener openings 120. FIG. 6 illustrates an exterior side view of one embodiment of the top portion 112 and/or bottom portion 114. In this embodiment, the top portion 112 and the bottom portion 114 mirror each other with mating elements 122.

It is recognized that varying embodiments may include multiple mating elements 122 solely on the bottom portion or the top portion. Similarly, varying embodiments may include different the number and/or placement of fastener openings on the side portion 116, such as for example a single fastener opening 120 in the center of the side portion 116 instead of two openings 120 near the mounting flanges 118. As described further below, in this embodiment for the top portion 112 and the bottom portion 114, the mating elements 122 allow fasteners to engage the pull assembly (130 of FIG. 3) into the mounting assembly 120. It is recognized that varying embodiments allow for varying the number and/or locations of the fastener openings 120 and/or mating elements 122 such that the above-described embodiments are exemplary and limiting in nature.

Figure 7:
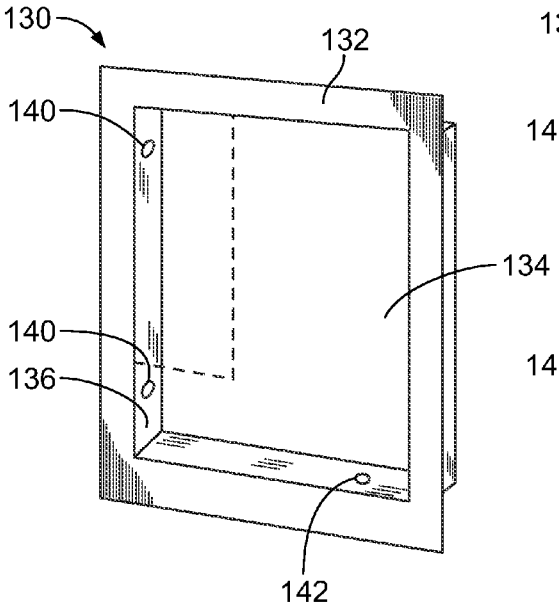
FIG. 7 is a perspective view of one embodiment of a pull handle.

FIG. 7 illustrates a first perspective view of one embodiment of the pull assembly 130. In this illustrated embodiment, the extending portion of the assembly face 132 is omitted to illustrate underlying elements. The pull assembly 130 includes the assembly face 132, assembly interior 134, a first interior face 136 and a second interior face 138 (visible in FIG. 8).

The first interior face 136 includes a plurality of flange mount openings 140. As described below, the flange mount openings 140 are positioned to accept the mounting flanges 118 of the mounting assembly 110 of FIG. 4.

The assembly interior 134 further includes fastener openings 142, whereby this embodiment shows the bottom fastener opening 142.

Figure 8:
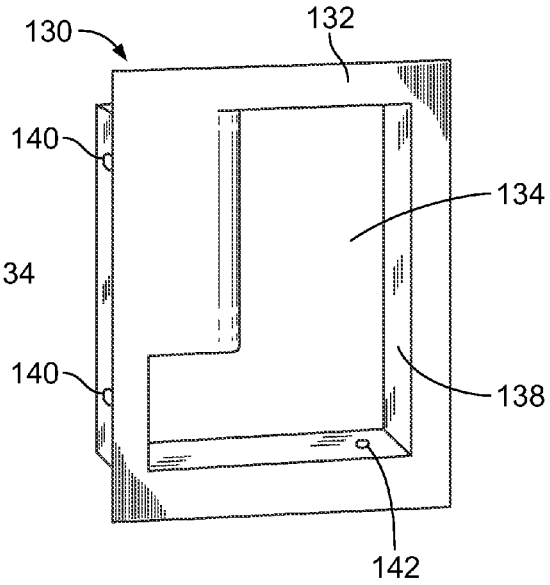
FIG. 8 is another perspective view of one embodiment of a pull handle.

FIG. 8 illustrates the second perspective view of this embodiment of the pull assembly 130. Illustrated herein, the flange mount openings 140 extend through the interior portion 134 and the fastener opening 142 is on the bottom edge of the interior portion 134. While not visible in FIG. 8, one embodiment includes a second fastener opening on the top face of the interior portion 134, as better illustrated in FIG. 11. In the embodiment of FIG. 8, the second interior side 138, illustrated herein having no openings, but being a solid interior portion. Similar to the varying of the position and number of mounting flange(s) 118 and mating elements 122 of the mounting assembly 110, the number and position of flange mount openings 140 and fastener openings 142 may be accordingly varied.

Figure 9:
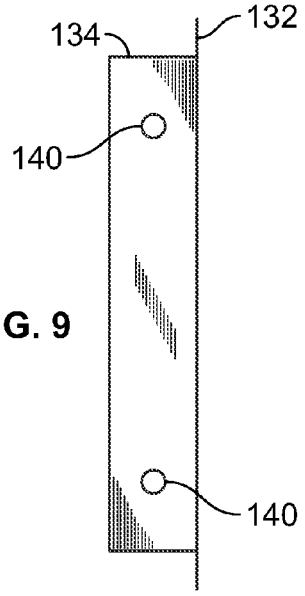
FIG. 9 is a side view of one embodiment of a pull handle.
Figure 10:
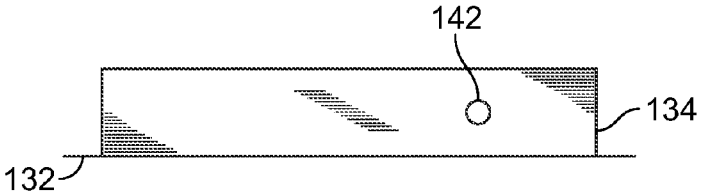
FIG. 10 is a top view of one embodiment of a pull handle.
Figure 11:
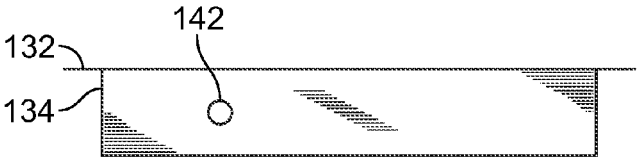
FIG. 11 is a bottom view of one embodiment of a pull handle.

FIGS. 9-11 illustrate additional views of the pull assembly 130. FIG. 9 is a side view illustrating the face 132 extending outward from and beyond the interior portion 134. The interior portion 134 extends back from face 132, allowing for hand access to grab the extending face portion and pull on the door handle to open the door. FIG. 9 also illustrates the placement of the flange mount openings 140 in this embodiment.

FIG. 10 is a bottom view illustrating the placement of the fastener opening 142 relative to the assembly face 132 and the assembly interior 134. Also visible is the overly or extension of the face 132 beyond the interior 134. FIG. 11 is a top view providing similar illustration of this embodiment of the pull assembly with the fastener opening 142, assembly face 134 and assembly interior 134.

In one embodiment, the flush pull handle may be constructed with an architectural finish, such as having a polish finish consistent with commercial-grade esthetics. The handle may be composed of 11-gauge stainless steel, but any suitable material recognized by one skilled in the art in within the scope of the present invention.

In one embodiment, the mounting assembly 110 has a general dimension of a width of 5.75 inches, a height of 8.32 inches and a depth of 1.5 inches. The mounting flanges 118 extend out 1.12 inches from the assembly 110, centrally disposed within the sidewall of the assembly, each flange disposed 1.74 inches from the top edge and bottom edge, respectively. The pull assembly has a width of 6.3 inches, height of 9.47 inches and depth of 1.62 inches. The curved portion of the handle for grasping has a distance of 0.38 inches and a bottom gap between the handle extending portion and the bottom of the interior portion is 2.29 inches.

Figure 12:
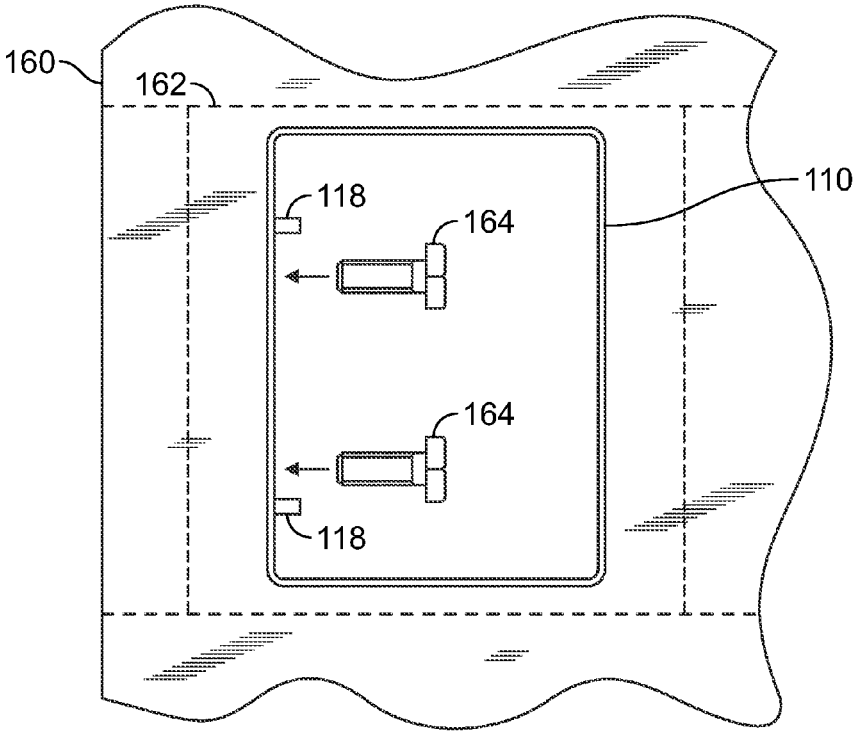
FIG. 12 is a front view illustrating one embodiment of mounting assembly installation.

It is recognized that the above measurements, dimensions and materials are exemplary in nature of one embodiment. These measurements, dimensions and materials are not limiting in nature and do not restrict or otherwise limit the scope of the flush pull handle described herein as the measurements, dimensions and materials may be modified or adjusted as recognized by one skilled in the art.

Where FIGS. 2-11 illustrate one exemplary embodiment of mounting assembly 110 and pull assembly 130, FIG. 12 illustrates one embodiment of securing the mounting assembly 110 relative to a door 160. The door 160 may be any suitable door, including for example but not limited to a metal, wood, or aluminum door. The door 160 includes an interior bracing assembly 162 capable of receiving the mounting assembly 110. This bracing assembly 162 may be a strip of bracing material having the proper strength and rigidity to fit within the interior of the door and having an opening commensurate with the size of the mounting assembly 110. In one embodiment, the bracing assembly 162 may be a continuous piece of metal or aluminum or any other suitable material extending lengthwise across a portion of the door. In another embodiment, the bracing assembly may be a bracket assembly secured into the interior, such as the vertical channel 162. For example, in one embodiment, the bracket assembly may be welded into place prior to finishing the exterior or skin of the door.

In securing the mounting assembly 110 to the bracing assembly 162, the mounting assembly 110 is placed within a receiving portion. When received, a plurality of fasteners are inserted through the fastener openings (120 of FIG. 4) for securing the mounting assembly 110 to the bracing assembly 162. In this embodiment, the fasteners 164 are screws and are placed just below the mounting flanges 118. It is recognized that any other suitable fastener may be utilized and the embodiment of screws is not limiting or exclusive for securing the mounting assembly 110 to the bracing assembly 162. For examples, fasteners may include nails, rivets, screws, welds, etc.

In another embodiment, the mounting assembly may be affixed using non-fastener means, but any other suitable securing means. For example, the mounting assembly may be affixed in the door using welds, adhesives, glues, snap-fit, or any other suitable means recognized by one skilled in the art.

Figure 13:
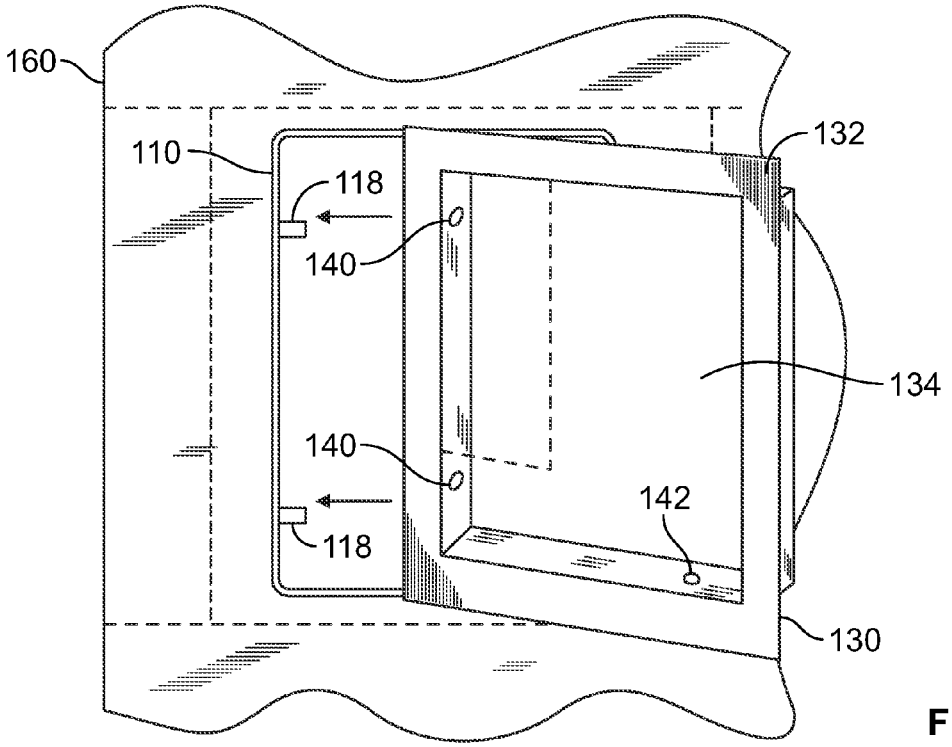
FIG. 13 is a perspective view illustrating one embodiment of pull handle assembly.

FIG. 13 illustrates the mating of the pull assembly 130 into the mounting assembly 110 as secured within the door 160. Similar to FIG. 7, a portion of the assembly face 132 is removed to illustrate the alignment of the mounting flanges 118 with the flange mount openings 140 of the pull assembly 130. The interior portion 134 fits within the mounting assembly 110 and the assembly face 132 extends around and covers up the mounting flange 118. Also visible in FIG. 13, the fastener opening 142 is located in the interior portion 134. As the pull assembly 130 is fitted into the mounting assembly 110 and the mounting flanges 118 extend through the flange mount openings 140, the pull assembly 110 is then flush mounted against the door 160. The assembly face 132 occludes the mounting assembly 110.

Figure 14:
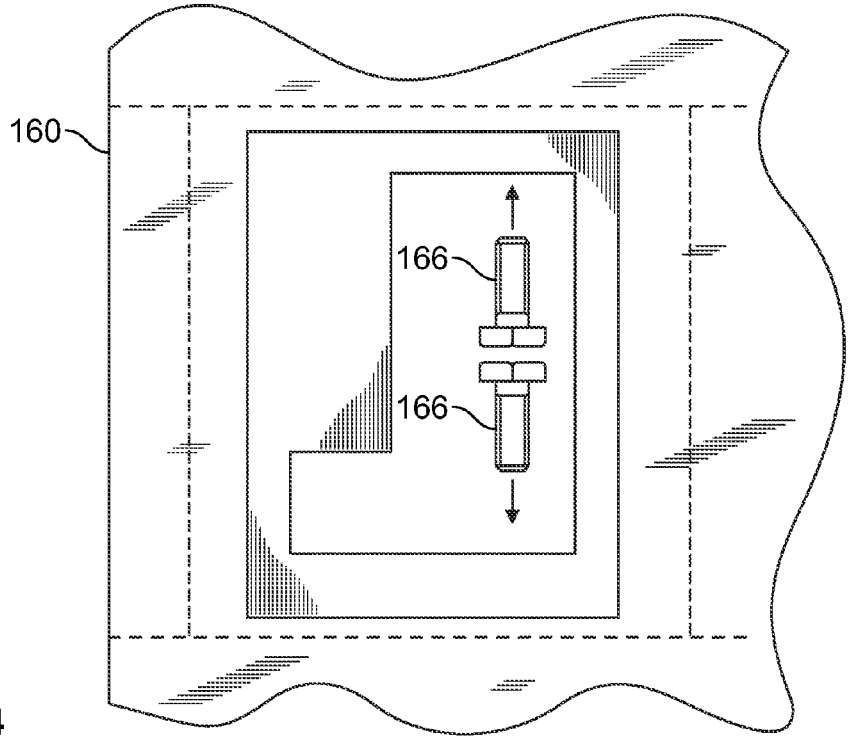
FIG. 14 is a front view illustrating one embodiment of pull handle installation.

FIG. 14 illustrates the final step in the flush mount assembly with the placement of fasteners 166 into fastener openings (142 of FIG. 13). Therefore, the pull assembly 130 is secured to the mounting assembly 110 via the flanges 118 and is secured to the door by the fasteners 166 passing through the fastener openings (142 of FIG. 13) and into the mating elements of the mounting assembly (122 of FIG. 4). In this embodiment, the mounting flanges are flush with the side of the interior portion and thus not visible.

In this embodiment, the flush pull handle does not include any interior latching or door locking mechanisms. Rather, the flush pull handle works with doors having other security means for monitoring ingress and egress. For example, the door with the flush pull handle may include a security card or other type of security access that when activated released a latching mechanism to allow the door to open from the flush pull handle side. Similarly, the flush pull handles may be on the opposing side of a door having push bars that allow for pushing the door open from the opposite side when the door is locked. In one embodiment, the flush pull handle operates with doors typically remaining unlocked and generally accessible during normal hours, such as doors found in a school, library, government office, etc.

As noted above, the flush pull handle being mounted via the mounting assembly into the channel 162 of the door prohibits access to the other side of the door. Similarly, if the pull handle is removed, there is no access to any of the locking mechanisms of the door, further enhancing the safety of the flush pull handle. In another embodiment, the mounting assembly 110 may include a backing, such backing can be a means to affix the mounting assembly into the door itself. The backing may include a material or coating providing for a fire-rating of the door. Similarly, such backing and/or coating can be affixed to the pull handle, thus allowing for further enhanced safety, in this embodiment for meeting fire-rating or fire code requirements.

It is further recognized that alternative embodiments may be realized relating to the positioning of the mounting flange(s) and fasteners. While illustrated herein having 2 mounting flanges, it is recognized that any number of mounting flanges may be utilized and the position of the mounting flanges may be adjusted as recognized by one skilled in the art. In the preferred embodiment, the mounting flange(s) are positioned on a single side allowing for the pull assembly to be slid or positioned into place. It is recognized that based on tolerances and adjustment factors, multiple mounting flanges on neighboring or opposing sides may be utilized to further secure the pull assembly relative to the mounting assembly.

While the mounting assembly is described herein having a rectangular shape, it is recognized that varying shapes may be utilized and are within the scope of the present invention. Such rectangular shape, including for example curved or slightly rounded edges, provides a means for simplicity of installation by insuring the pull assembly is not improperly mounted. But it is within the scope herein to include additional shapes for the mounting assembly, such as a circular, oval or oblong shape, wherein the mounting flanges may be disposed through flange mount openings.

Furthermore, while the inclusion of fasteners allow for the ease of installation and ease or removal of the mounting assembly and/or pull assembly, it is additionally recognized that mounting assembly is generally affixed to the door and the pull assembly is affixed to the mounting assembly. Therefore, varying embodiments may include the flush pull door handle to not be designed for removal, for example of the affixing is performed using a more permanent solution such as welding, high-strength glue, or other means.

In another embodiment, the pull handle itself may include an offset grip to allow for ease of gripping for opening the door. As noted above, the shape of the grip portion may also vary, such as having a triangle shape or cascading edges by way of example. In the embodiment described above, the shape of the pull portion of the pull assembly prohibits application of securing means to hold the doors together. For example, the flush pulls do not allow for placement of chains or ropes around the door. In the event someone attempted to place a clamp, the cut-away portion at the bottom of the grip portion provides a means for the doors to be agitated by pushing out and causing the clamp to slight down into the open gap and hence fall off the door.

While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected.

What is claimed is:

1. A flush pull handle affixable to a door, the flush pull handle comprising: a mounting assembly including a top portion, a bottom portion, a first side portion, and a second side portion, the top portion, bottom portion, first side portion, and second side portion defining an interior space of the mounting assembly, the mounting assembly affixable within an interior portion of the door via at least one fastener securely engaging the mounting assembly within the interior portion; at least one mounting flange disposed within the interior space of the mounting assembly; a pull assembly including an assembly interior portion having a first interior side and a second interior side, the first interior side having at least one flange mount opening; and the pull assembly including an assembly face having a handle portion flush with the assembly face and protruding across at least a portion of the assembly interior portion for allowing a pulling action on the pull handle; wherein the pull assembly mounts in the interior space of the mounting assembly within the interior portion of the door the such that the at least one mounting flange protrudes through the at least one flange mount opening and into the pull assembly.

2. The flush pull handle of claim 1 further comprising:

at least one fastener opening on the mounting assembly for affixing the mounting assembly to the door.

3. The flush pull handle of claim 2, wherein the interior portion of the door includes a receiving assembly to which the mounting assembly is affixed via at least one fastener via the at least one fastener opening.

4. The flush pull handle of claim 2, wherein the at least one fastener is at least one screw.

5. The flush pull handle of claim 1 further comprising:

at least one fastener opening on the pull assembly for securing the pull assembly to the mounting assembly.

6. The flush pull handle of claim 5, wherein the at least one mounting flange comprises: a first mounting flange and a second mounting flange disposed on the mounting assembly; and wherein the at least one flange mount opening includes a first flange mount opening and a second flange mount opening on the pull assembly such that when the pull assembly is mounted within the mount assembly, the first mount flange protrudes through the first flange mount opening and the second mounting flange protrudes through the second flange mount opening.

7. The flush pull handle of claim 1, wherein the handle portion on the assembly face extends along only a portion of a height of the assembly interior portion.

8. The flush pull handle of claim 1, wherein the handle portion on the assembly face extends along only a portion of a width of the assembly interior portion.

9. A flush pull handle affixable to a door, the handle comprising: a mounting assembly including a top portion, a bottom portion, a first side portion, and a second side portion, the top portion, bottom portion, first side portion, and second side portion defining an interior space of the mounting assembly; at least one mounting flange disposed on one of: the top portion, the bottom portion, the first side portion, and the second side portion of the mounting assembly, the at least one mounting flange protruding into the interior space of the mounting assembly; at least one fastener opening on the mounting assembly for affixing the mounting assembly within an interior portion of the door by allowing at least one fastener to extend through the at least one fastener opening and engage the interior portion of the door; a pull assembly including an assembly interior portion having at least one flange mount opening; and the pull assembly including an assembly face having a handle portion flush with the assembly face and protruding across at least a portion of the assembly interior portion; wherein the pull assembly mounts in the interior space of the mounting assembly within the interior portion of the door such that the at least one mounting flange of the mounting assembly protrudes through the at least one flange mount opening and into the pull assembly.

10. The flush pull handle of claim 9, wherein the interior portion of the door includes a receiving assembly to which the mounting assembly is affixed via the at least one fastener via the at least one fastener opening.

11. The flush pull handle of claim 10, wherein the at least one fastener is at least one screw.

12. The flush pull handle of claim 9 further comprising:

at least one pull assembly fastener opening on the pull assembly for securing the pull assembly to the mounting assembly.

13. The flush pull handle of claim 12, wherein the pull assembly is secured to the mounting assembly via the mounting flange and at least one pull assembly fastener fastening the pull assembly to the mounting assembly.

14. The flush pull handle of claim 13, wherein the at least one pull assembly fastener is at least one screw.

15. The flush pull handle of claim 9, wherein the at least one mounting flange comprises: a first mounting flange and a second mounting flange disposed on the first side portion of the mounting assembly; and wherein the at least one flange mount opening includes a first flange mount opening and a second flange mount opening on a first interior side of the interior portion of the pull assembly such that when the pull assembly is mounted within the mount assembly, the first mounting flange protrudes through the first flange mount opening and the second mounting flange protrudes through the second flange mount opening.

16. The flush pull handle of claim 15, wherein the first mounting flange and the second mounting flange are obscured from view by the assembly face.

17. A door having a flush pull handle, the door comprising: a mounting brace within an interior portion of the door; a mounting assembly including a top portion, a bottom portion, a first side portion, and a second side portion, the top portion, bottom portion, first side portion, and second side portion defining an interior space of the mounting assembly, the mounting assembly affixable to the mounting brace via at least one fastener within the interior portion of the door; at least one mounting flange disposed within the interior space of the mounting assembly; a pull assembly including an assembly interior portion having a first interior side and a second interior side, the first interior side having at least one flange mount opening; and the pull assembly including an assembly face having a handle portion flush with the assembly face and protruding across at least a portion of the assembly interior portion for allowing a pulling action on the pull handle; wherein the pull assembly mounts in the interior space of the mounting assembly within the interior portion of the door such that the at least one mounting flange of the mounting assembly protrudes through the at least one flange mount opening and into the pull assembly.

18. The door of claim 17 further comprising:

at least one fastener opening on the pull assembly for securing the pull assembly to the mounting assembly.

19. The door of claim 18, wherein the pull assembly is further secured to the mounting brace.

20. The door of claim 18, wherein the at least one mounting flange comprises: a first mounting flange and a second mounting flange disposed on the mounting assembly; and wherein the at least one flange mount opening includes a first flange mount opening and a second flange mount opening on the pull assembly such that when the pull assembly is mounted within the mount assembly, the first mount flange protrudes through the first flange mount opening and the second mounting flange protrudes through the second flange mount opening.

* * * * *